US010946605B2

(12) United States Patent
Kuhn et al.

(10) Patent No.: US 10,946,605 B2
(45) Date of Patent: Mar. 16, 2021

(54) FILLING DEVICE AND FILLING METHOD

(71) Applicant: AUTEFA SOLUTIONS GERMANY GMBH, Friedberg (DE)

(72) Inventors: Rudolf Kuhn, Neusäß (DE); Norbert Sauerwein, Augsburg (DE)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 451 days.

(21) Appl. No.: 15/576,022

(22) PCT Filed: May 23, 2016

(86) PCT No.: PCT/EP2016/061538
§ 371 (c)(1),
(2) Date: Nov. 21, 2017

(87) PCT Pub. No.: WO2016/188940
PCT Pub. Date: Dec. 1, 2016

(65) Prior Publication Data

US 2018/0200978 A1 Jul. 19, 2018

(30) Foreign Application Priority Data

May 27, 2015 (DE) ..... 20 2015 102 730.3

(51) Int. Cl.
*B30B 9/30* (2006.01)
*B65B 27/12* (2006.01)

(52) U.S. Cl.
CPC ..... *B30B 9/3007* (2013.01); *B30B 9/301* (2013.01); *B30B 9/3028* (2013.01); *B30B 9/3032* (2013.01); *B30B 9/3078* (2013.01); *B65B 27/125* (2013.01)

(58) Field of Classification Search
CPC ... B30B 9/3007; B30B 9/3028; B30B 9/3032; B30B 9/3078; B30B 9/301; B65B 27/125
See application file for complete search history.

(56) References Cited

U.S. PATENT DOCUMENTS 3,451,185 A * 6/1969 Tezuka ..... B30B 9/3078 53/397
3,693,541 A * 9/1972 Lombard ..... B30B 9/3007 100/137

(Continued)

FOREIGN PATENT DOCUMENTS

AT 510 053 A1 1/2012
DE 28 19 807 A1 11/1978

(Continued)

*Primary Examiner* — Jimmy T Nguyen
(74) *Attorney, Agent, or Firm* — McGlew and Tuttle, P.C.

(57) ABSTRACT

A filling device (3) and a filling method for fibrous material (6) on a bale press (1). The filling device (3) is arranged between a fiber supply (2) and a pressing device (5) of the bale press and comprises a collecting chamber (9) for the fibrous material (6) with a supply opening (16) as well as a discharge opening (17) with a controllable closure (18). A driven slide (25) of an integrated precompression device (4) is movable in a reversing manner between the openings (16, 17), which precompresses the collected fibrous material in one or more stages in the collection chamber (9) before collected fibrous material is transferred to the pressing device.

20 Claims, 7 Drawing Sheets

(56) References Cited

U.S. PATENT DOCUMENTS 3,908,538 A * 9/1975 Boyd ..... B30B 9/3078 100/49
3,996,850 A * 12/1976 Whitener ..... B30B 9/3028 100/220
4,040,230 A * 8/1977 Pessel ..... B65F 9/00 53/438
4,041,855 A * 8/1977 Egosi ..... B30B 9/3028 100/138
4,108,063 A * 8/1978 Randolph ..... B30B 9/3003 100/215
4,125,068 A * 11/1978 Linnerz ..... B30B 9/3003 100/11
4,162,603 A * 7/1979 Stromberg ..... B30B 9/301 53/438
4,650,546 A * 3/1987 Le Jeune ..... B09B 3/00 201/6
5,471,919 A * 12/1995 Dabizzi ..... B30B 9/301 100/14
5,493,963 A * 2/1996 Curles ..... B30B 9/3028 100/215
5,687,643 A * 11/1997 Felts ..... B30B 9/301 100/207
6,085,486 A * 7/2000 Hunter ..... B30B 9/3007 100/17

FOREIGN PATENT DOCUMENTS

| | | | |
|---|---|---|---|
| DE | 30 47 673 | A1 | 7/1982 |
| DE | 42 23 046 | A1 | 1/1994 |
| DE | 296 09 493 | U1 | 11/1997 |
| DE | 200 14 583 | U1 | 6/2001 |
| DE | 10 2005 042 217 | A1 | 3/2007 |
| DE | 10 2009 056 546 | A1 | 6/2011 |
| DE | 20 2012 100 284 | U1 | 6/2012 |
| WO | 97/45251 | A1 | 12/1997 |
| WO | 2011/066977 | A1 | 6/2011 |

* cited by examiner

FILLING DEVICE AND FILLING METHOD

CROSS REFERENCE TO RELATED APPLICATIONS

This application is a United States National Phase Application of International Application PCT/EP2016/061538, filed May 23, 2016, and claims the benefit of priority under 35 U.S.C. § 119 of German Application 20 2015 102 730.3, filed May 27, 2015, the entire contents of which are incorporated herein by reference.

FIELD OF THE INVENTION

The present invention pertains to a filling device and to a filling method for fibrous material on a baling press, wherein the filling device is configured for an arrangement between a fiber feed and a pressing device of the baling press and comprises a collecting chamber for the fibrous material with a feed opening as well as with a discharge opening and with a driven slide, which is movable in a reversing manner between the openings.

BACKGROUND OF THE INVENTION

Such a filling device is known from DE 296 09 493 U1. It is arranged between a fiber feed and a pressing device on a baling press and comprises a collecting chamber for the fibrous material with a feed opening and with a discharge opening as well as with a driven slide which is movable in a reversing manner between the openings. The collecting chamber leads to a press shaft of the baling press, wherein the slide pushes over the collected fibrous material into the press shaft and compacts it somewhat in the press shaft here.

SUMMARY OF THE INVENTION

An object of the present invention is to provide an improved filling device.

The filling technology claimed, i.e., the filling device and the corresponding method, have a variety of advantages. The claimed precompaction of the collected fibrous material in the fiber chamber can take place during the operation of the pressing device. The precompaction and the pressing of the fibrous material, which is carried out at a higher pressing pressure, can be overlapped chronologically during formation of the pressed bale. The precompaction and pressing with bale formation take place in separate locations. In addition, advantages are obtained for fleecy fibers, which need a multistage compaction and pressing.

The entire filling and pressing process during the pressed bale formation can be expedited and be shortened in duration. The performance of a filling device and of a baling press equipped with it can be increased and the efficiency can be increased with the filling technology being claimed.

With its precompaction, the filling device can form a buffer storage for the fibrous material. The buffered fiber volume can thereby be substantially reduced by means of the precompaction. This in turn allows a reduction in the size of the baling press, especially in the area of the fiber feed.

Furthermore, the precompacted fibrous material can be pushed over into the pressing device more rapidly and with a greater quantity of fiber contained and be further compacted there and pressed into a bale. The compacting in the pressing device can take place in multiple stages. Due to the chronological and spatial separation for precompaction, the compacting is able to take place more efficiently. The filling device preferably subsequently delivers precompacted fibrous material only if the previous batch of fibrous material is already sufficiently compacted.

The filling technology being claimed can be integrated into new baling presses. As an alternative, it can be used to retrofit or convert existing baling presses.

The filling technology being claimed has further the advantage that the precompaction by the slide can take place within the collection area. The fibrous material may finally also be pushed over with the slide as a complete, precompacted batch into the pressing device, especially into a press shaft there. A single slide is sufficient for this. The multiple function of the slide also offers advantages for the saving of space and for a reduced configuration and control effort. A horizontal or oblique arrangement of the collecting chamber is also favorable.

A closure at the discharge opening of the collecting chamber may perform a plurality of functions. It may offer the necessary support for the precompaction in the collecting chamber, on the one hand. On the other hand, it may close the opening to a press shaft and form a part of the press shaft wall there for the further compacting and pressing of the fibrous material.

A retaining device in the collecting chamber has the advantage that the fibrous material, which is preferably precompacted in batches, remains in the compaction area and the collection area can again be filled undisturbed. A pivotable arrangement of bent retaining arms has the advantage of a minimal space requirement and of a simplified drive and control technology.

The present invention is shown schematically and with examples in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
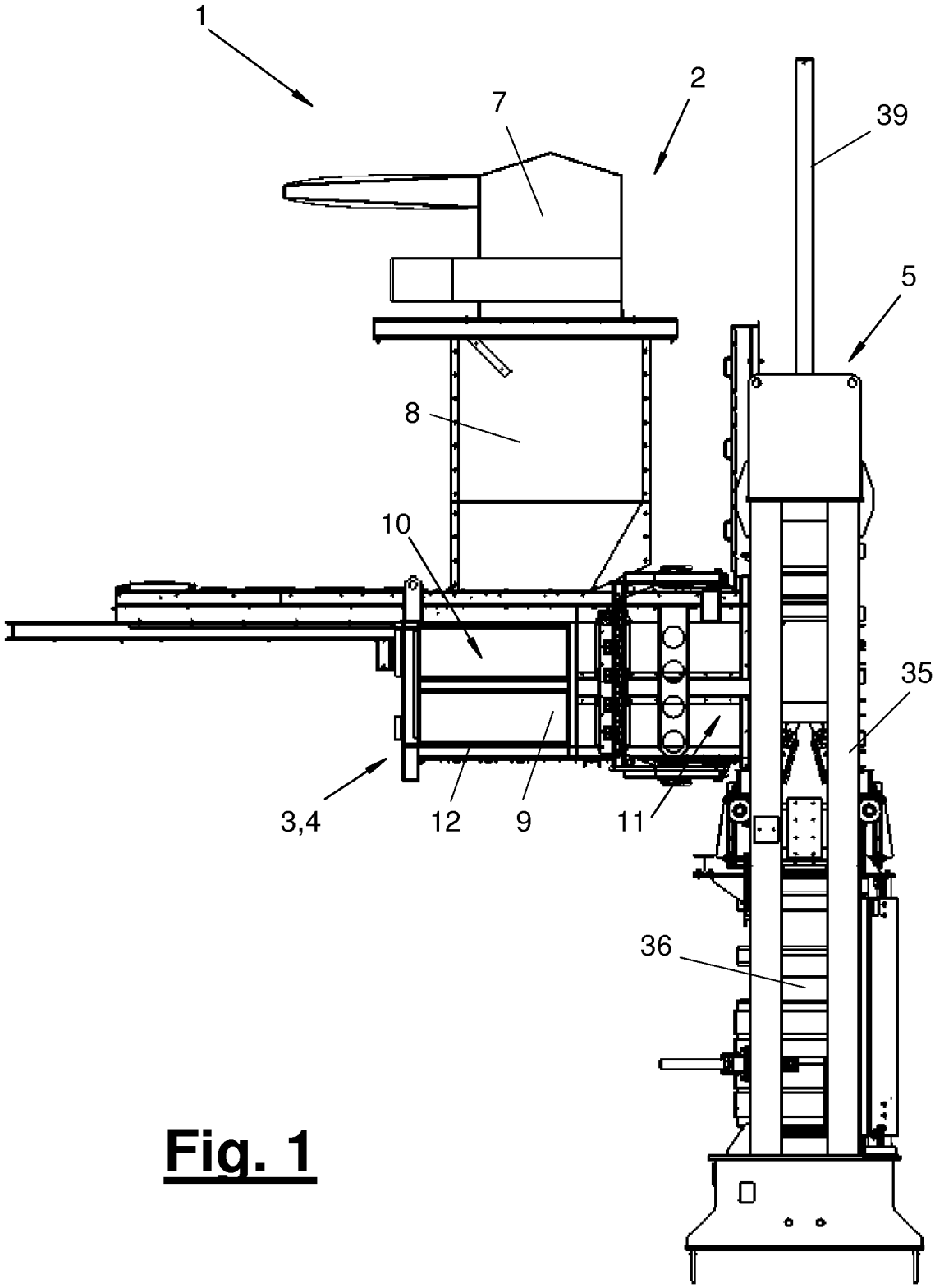
FIG. 1 is a side view of a baling press with a filling device and with a precompacting device.
Figure 2:
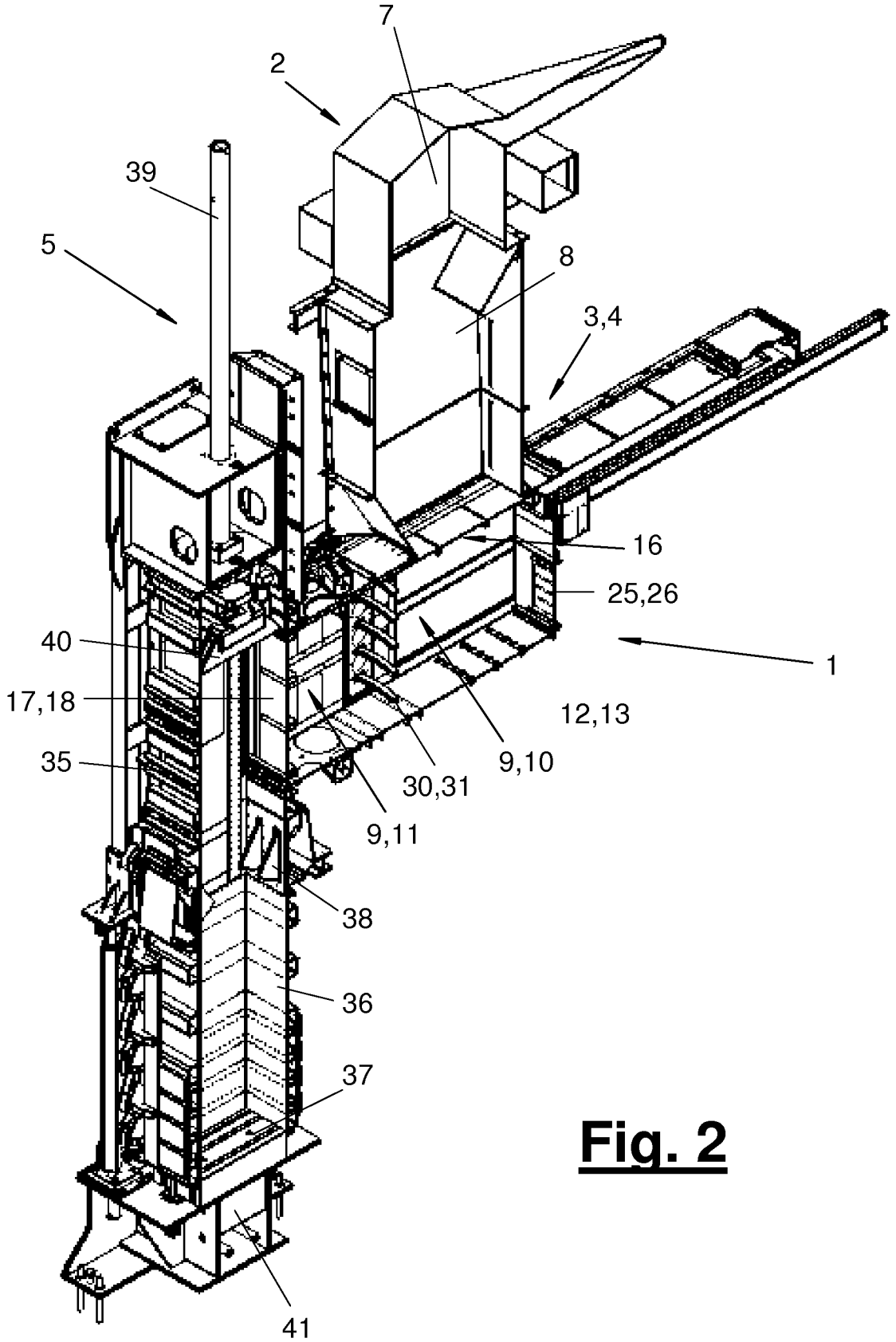
FIG. 2 is a broken-open perspective view of the arrangement from FIG. 1 with a view from the opposite side.

Referring to the drawings, the present invention pertains to a filling device (3) for fibrous material (6) and to a corresponding method. The present invention further pertains to a baling press (1) equipped with such a filling device (3) and to a baling press method.

Figure 7:
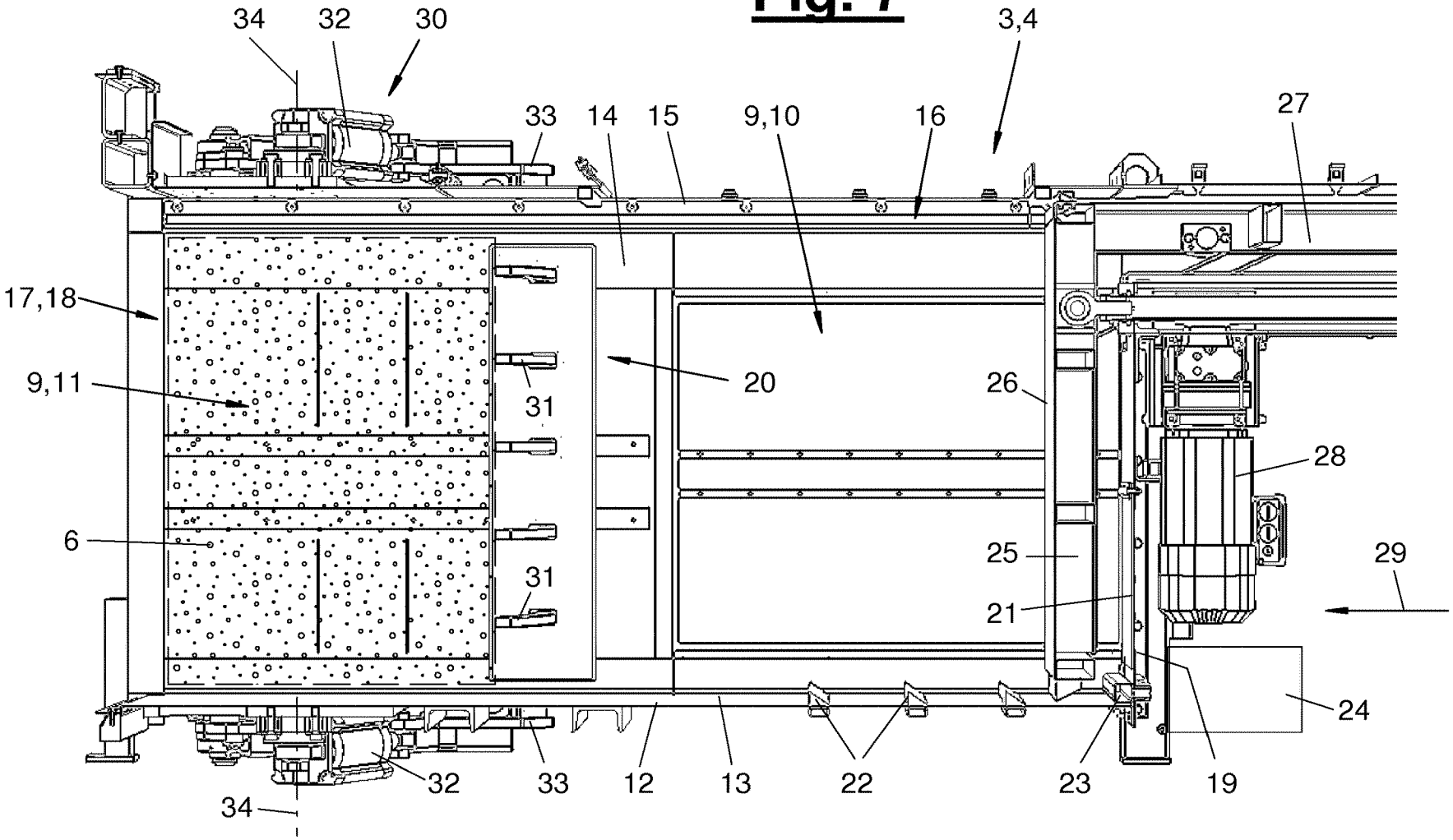
FIG. 7 is a broken-off longitudinal sectional view through the filling device.

FIG. 1 shows a baling press (1) for manufacturing highly compacted pressed bales from a fibrous material (6), which is indicated schematically in FIG. 7. The fibrous material (6) is preferably cut fibers, so-called staple fibers. As an alternative, the fibrous material (6) may consist of long fiber strands, so-called tow, and the fibrous material (6) preferably consists of synthetic fibers. As an alternative, it may be natural fibers, mixed materials or the like.

The baling press (1) comprises a fiber feed (2), a filling device (3) with a precompacting device (4) and a pressing device (5). Further, a weighing device (not shown) for the fibrous material (6) may be present, e.g., at the filling device (3) and/or at another location.

The fibrous material (6) is fed into the fiber feed (2) from a fiber preparation area. The fiber feed (2) comprises, e.g., a condenser (7) for separating the fibers from a transportation air stream and an adjacent feed shaft (8). The fibrous material (6) reaches the filling device (3) from the fiber feed (2), especially the feed shaft (8). It is collected there and precompacted with the precompacting device (4) as well as subsequently pushed over into the pressing device (5). The filling device (3) and the precompacting device (4) will be explained in detail below.

The pressing device (5) comprises a frame with a press shaft (35) and with a press drive (39) as well as with press plungers (40, 41), between which the fibrous material (6) is compacted and pressed in one or more stages or pressing strokes. This may be a combined prepressing and final pressing with the formation of a pressed bale. The pressed bale (not shown) may, in addition, be provided with a packaging or wrapping and/or a fixing, especially with a strap (not shown). As an alternative, only a prepressing may take place in the pressing device (5), wherein the final pressing takes place at a different location and at a later time.

The press shaft (35) and the press drive (39) are preferably aligned upright, especially vertically. At a preferably lower end area, the press shaft comprises a mobile press box (36), in which the pressed bale is formed. The mobile press box (36) may be movable and changeable together with the pressed fibrous material. It may, as an alternative, comprise a closable opening for removal of the pressed material. The press box (36) may comprise retainers (38) for the fibrous material, which retainers can be introduced into the shaft area.

The press drive (39) is configured, e.g., as a hydraulic press cylinder. In the embodiment shown, the press drive (39) is arranged on the upper side of the press shaft (35) and is connected to the upper press plunger (40). The upper starting or inoperative position of the press plunger (40) is located approximately at the level of or above the filling device and precompacting device (3, 4). The lower press plunger (41) forms a counter punch. It may be arranged as stationary. It may be located especially on the box bottom (37). The kinematics and arrangement of the press drive (39) may be reversed, as an alternative. In another variant, both press plungers (40, 41) may be driven.

The filling device (3) has a horizontal, especially horizontal or oblique, alignment. It is attached on the side of the press shaft (35). A discharge opening (17) with a controllable closure (18) is arranged at the point of entry. The closure (18) can be configured, e.g., as a movable partition with an actuating drive. The partition may be aligned, e.g., along the press shaft (35). It may thereby form a part of the press shaft wall.

The driven press plunger (40) can compact and press the fibrous material (6) located in the press shaft (35) when the closure (18) is closed. This pressing preferably takes place in a plurality of stages and with a plurality of pressing strokes, wherein fibrous material (6) that has been precompacted in batches is inserted from the filling device and the precompacting device (3, 4) into and compacted in the press shaft (35). The compacting takes place, e.g., in the press box (36).

The filling device (3) comprises a collecting chamber (9) for fibrous material (6) with a feed opening (16) as well as with the discharge opening (17) and with a driven slide (25), which is movable in a reversing manner between the openings (16, 17). The filling device (3) comprises an integrated precompacting device (4), which collects the fibrous material (6) in the collecting chamber (9) and also precompacts it in the collecting chamber (9) with the slide (25) in one or more stages. Loose, especially uncompacted fibrous material (6) is preferably filled through the feed opening (16) into the collecting chamber (9) in portions or in a plurality of so-called batches from the fiber feed (2) and is always precompacted here in the collecting chamber (9) with one or more strokes of the slide (25).

The precompacted fibrous material (6) is subsequently transported, especially pushed over into the press shaft (35) of the pressing device (5). Due to the precompaction of the fibrous material (6) within the precompacting device (4), relatively few pressing strokes of the press drive (39) are sufficient for the prepressing and/or final pressing and possibly for the pressed bale formation.

The filling device (3) with the integrated precompacting device (4) may form a separate unit with which a baling press (1) can be retrofitted or converted. It may also be an integral component of a baling press (1) as in the embodiment being shown.

The collecting chamber (9) is arranged horizontally or obliquely in the manner mentioned above. The feed opening (16) pointing towards the fiber feed (2) is arranged on the upper side of the collecting chamber (9). The discharge opening (17) is arranged at a distance from the feed opening (16) in the longitudinal direction of the collecting chamber (9) and is located on the one front side of the collecting chamber (9). The openings (16, 17) are arranged at an angle deviating from 180° to one another, and preferably at right angles to one another. The discharge opening (17) forms the transition point or entry to the press shaft (35). The above-mentioned closure (18) is arranged at the discharge opening (17). It may be selectively associated with the filling device and the precompacting device (3, 4) and/or with the pressing device (5).

The slide (25) is likewise arranged in the collecting chamber (9). It is movable in a reversing manner between the openings (16, 17) along the chamber bottom (13). In this case, it moves along the direction of feed (29) identified by arrows. Its stroke length reaches up to or into the discharge opening (17).

The collecting chamber (9) is enclosed by a chamber housing (12). This housing comprises a chamber bottom (13), upright side walls (14), an upper wall (15) with the feed opening (16) and possibly a rear wall (19). The rear wall (19) is located opposite the discharge opening (17).

Figure 4:
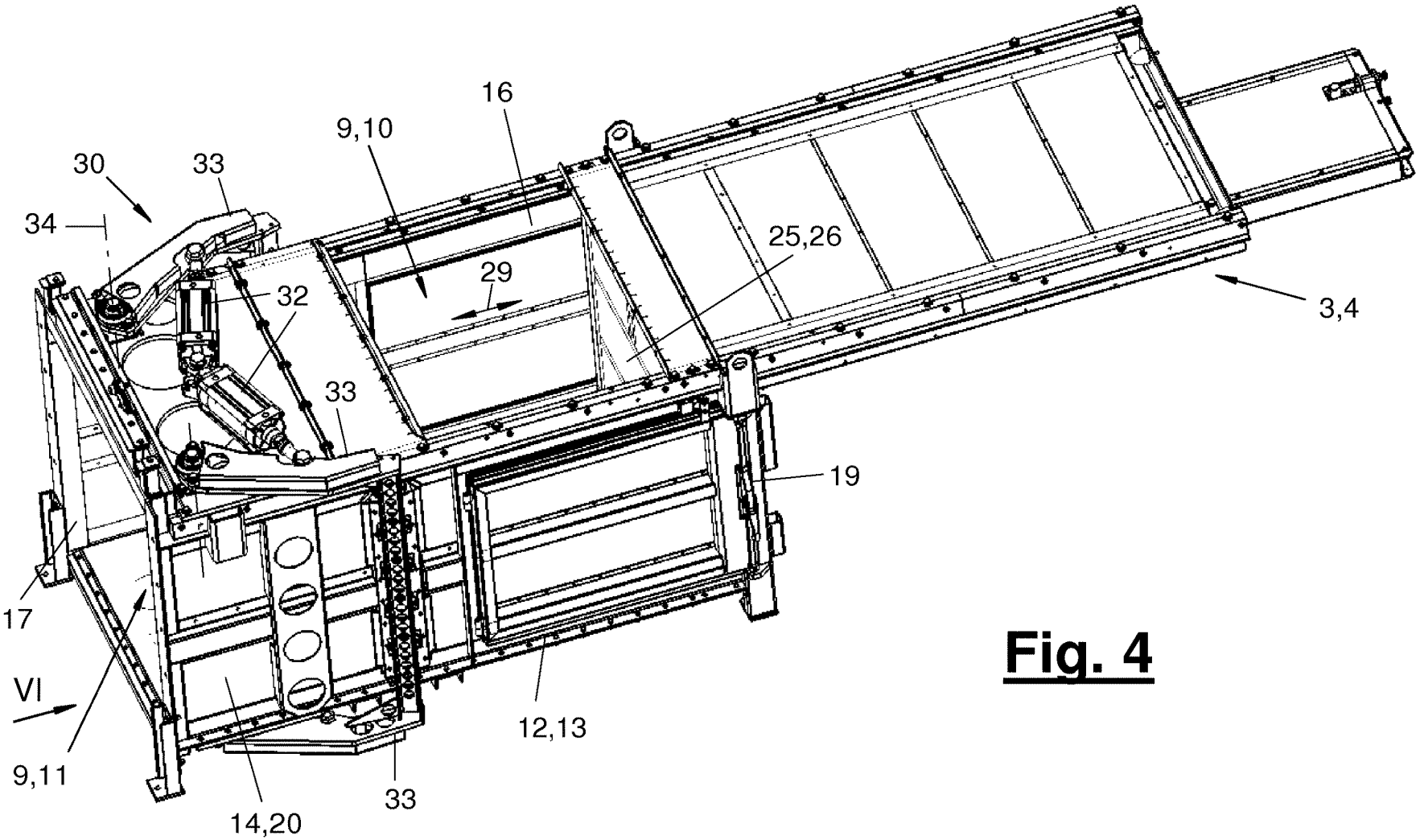
FIG. 4 is a perspective view of the filling device from one direction of view.
Figure 5:
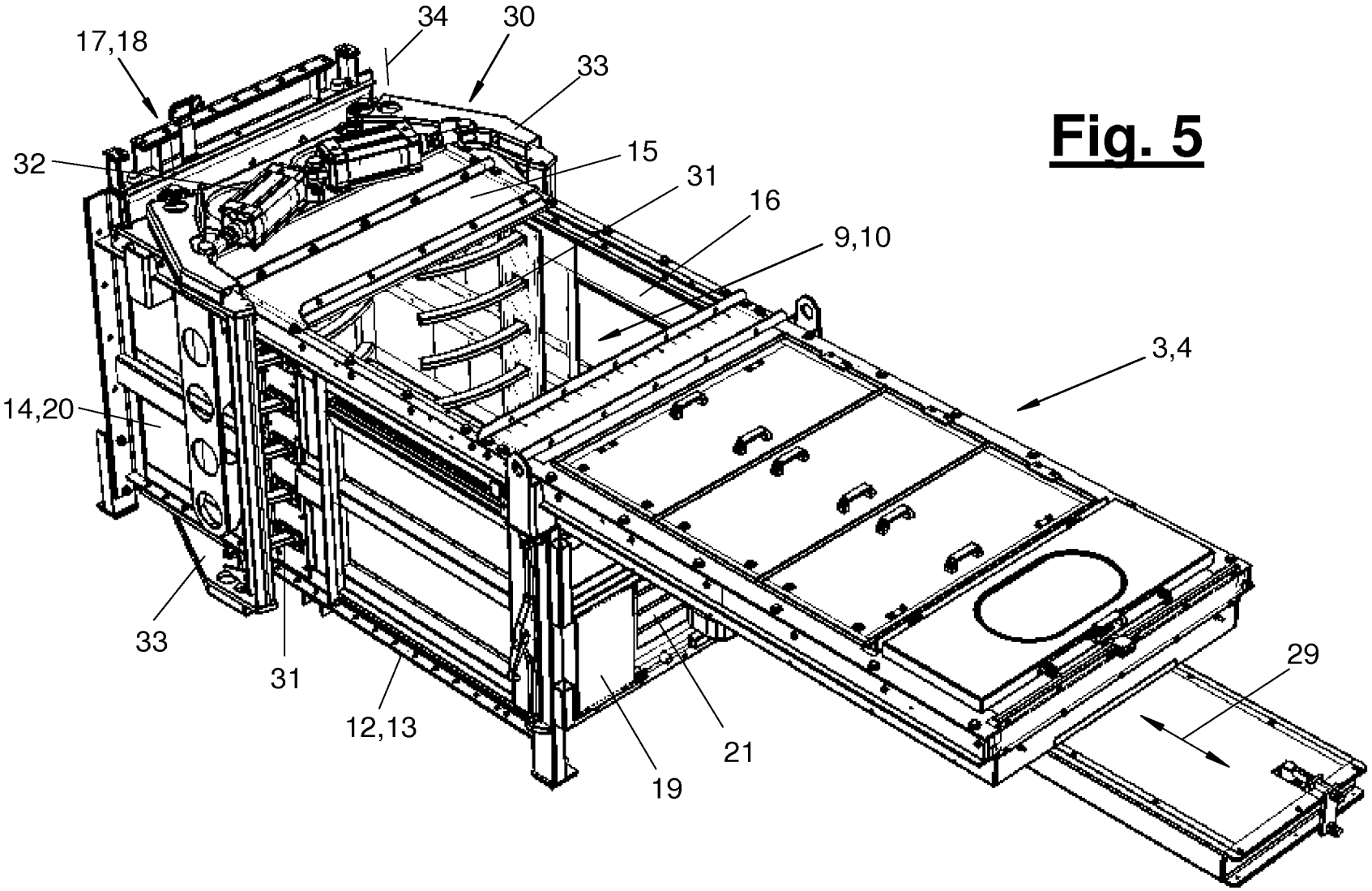
FIG. 5 is a perspective view of the filling device from another direction of view.

The slide (25) comprises an upright slide wall (26), which is arranged in the collecting chamber (9) or in the chamber housing (12). FIGS. 4 and 7 show this arrangement. The slide wall (26) is aligned essentially at right angles in relation to the longitudinal axis of the collecting chamber (9) and to the direction of feed (29).

The slide (25) may further comprise a cover wall (27) which is adjacent to the slide wall (26) at the top, which cover wall closes the feed opening (16) in the feed position of the slide (25). The cover wall (27) is aligned essentially at right angles in relation to the slide wall (26) and has a corresponding length for said closing function. As an alternative, another controllable closure may be present at the feed opening (16), with which closure the feed shaft (8) and the fiber feed can be closed and blocked.

The precompacting device (4) comprises an enlarged collecting chamber (9) with a collection area (10) and with a compaction area (11) arranged downstream, which areas are arranged behind one another in the direction of feed (29) of the slide (25). The discharge opening (17) is arranged at the front end of the compaction area (11). The compaction area (11) is located between the openings (16, 17). The controllable closure (18) closes the discharge opening (17) in case of one or more compaction strokes of the slide (25).

The chamber housing (12) comprises an enclosing, fiber-proof, closable wall at the compaction area (11). This wall is formed by the chamber bottom (13), the side walls (14) and the upper wall (15) closed in this area. The chamber housing (12) may comprise a vent (20) at the compaction area (11). This vent (20) lets the air contained in the fibrous material (6) escape from the compaction area (11) during the precompaction and retains the fibers. The vent (20) can be formed, e.g., by sieve-like wall sections.

The compaction area (11) is closed tightly on the front end face by the closure (18) during the compaction operation. As a result, the compaction area (11) is only open towards the collection area (10) for the fibrous material (6). The compaction area (11) is located in the collecting chamber (9) under the feed opening (16).

The precompacting device (4) further comprises a retaining device (30) for the fibrous material (6). This retaining device is arranged between the collection area (10) and the compaction area (11). The retaining device (30) is controllable. It interacts with the likewise controlled slide (25) and can be opened as well as subsequently closed again for the compaction feed and the subsequent return stroke thereof. In the closed position, it retains the fibrous material (6) located in the compaction area (11). A plurality of batches of fibrous material (6) can gradually be inserted into and collected as well as precompacted in the compaction area (11). The degree of precompaction may increase with the increase in the quantity of fiber.

The retaining device (30) comprises a plurality of mobile retaining elements (31), e.g., retaining arms, in the embodiment being shown, which retaining arms are acted upon by a controllable drive (32). The retaining arms (31) may dip into the collecting chamber (9) in a reversing manner.

The retaining arms (31) are preferably arranged on the side of the chamber housing (12), especially in the area of the side walls (14), on both sides and project through sealed wall openings. In this case, a plurality of retaining arms (31) are always arranged at a distance above one another. They form a sort of comb. A plurality of retaining arms (31) are preferably arranged on an arm support (33) at their outer end and their end located outside of the chamber housing (12) and connected to one another via this arm support. The drive (32) acts on the arm support (33) and moves this arm support (33) together with the retaining arms (31).

In the preferred embodiment, the arm support (33) is mounted rotatably about a pivot axis (34) at the chamber housing (12). In this case, the arm support (33) has, e.g., the fork shape shown, wherein the pivot axis (34) and the respective, corresponding bearings are arranged on the chamber bottom (13) and on the upper wall (15). The left and right arm supports (33) are mounted each about a separate pivot axis (34) separately from one another. The retaining arms (31) have a shape bent about their pivot axis (34) in this embodiment. They are preferably curved concentrically to the respective pivot axis (34).

The drive (32) of the retaining device (30) may be configured in any desired, suitable manner. It may comprise a central drive device or a plurality of separate and jointly controlled drive devices. In the exemplary embodiment being shown, four such drive devices are present, each of which is associated in pairs with an arm support (33). The drive devices are configured, e.g., as pneumatic or hydraulic cylinders. They are each supported on the chamber housing (12) and on the arm support (33) in an articulated manner.

The slide (25) likewise comprises a controllable drive (28). FIG. 7 shows this arrangement. For the purpose of precompaction, the drive (28) is controlled such that the slide (25) performs a plurality of reversing compaction strokes during a collection operation with the discharge opening (17) closed and collects fibrous material in batches in the compaction area (11) and precompacts the fibrous material in a plurality of stages. On completion of the precompaction, the closure (18) is opened, and the slide (25) can then push over the precompacted fibrous material (6) through the discharge opening (17) into the press shaft (35). The collection and precompacting operation may then start again. The collection and precompaction of the fibrous material (6) may run simultaneously with the pressing of the pushed over fibrous material (6) in the press shaft (35) with the closure (18) closed.

The drives (28, 32) of the slide (25) and of the retaining device (30) are controlled interdependently. The slide wall (26) preferably has a solid configuration, wherein the retaining device (30) performs a yielding motion during the feed of the slide (25) and pulls the retaining arms (31) from the collecting chamber (9) and immediately inserts them again after retraction of the slide (25). After the retraction of the slide (25) into the starting position at the rear wall (19), fibrous material (6) may again be filled into the collection area (10).

The drive (28) of the slide (25) may be configured in any desired, suitable manner. It is formed by a controllable electric motor and by a gear train, which is connected to the slide (25) in a suitable manner, in the exemplary embodiment being shown. The slide (25) comprises a rod-like guide that is mounted axially movably on the rear wall (19) in the exemplary embodiment shown according to FIG. 7. The gear train acts on this guide rod and may for this be configured, e.g., as a circulating belt drive.

As an alternative or in addition, the slide (25) may be guided in a different way, e.g., by means of a lateral guide of the slide wall (26) and/or of the possibly present cover wall (27) at the chamber housing (12).

Figure 6:
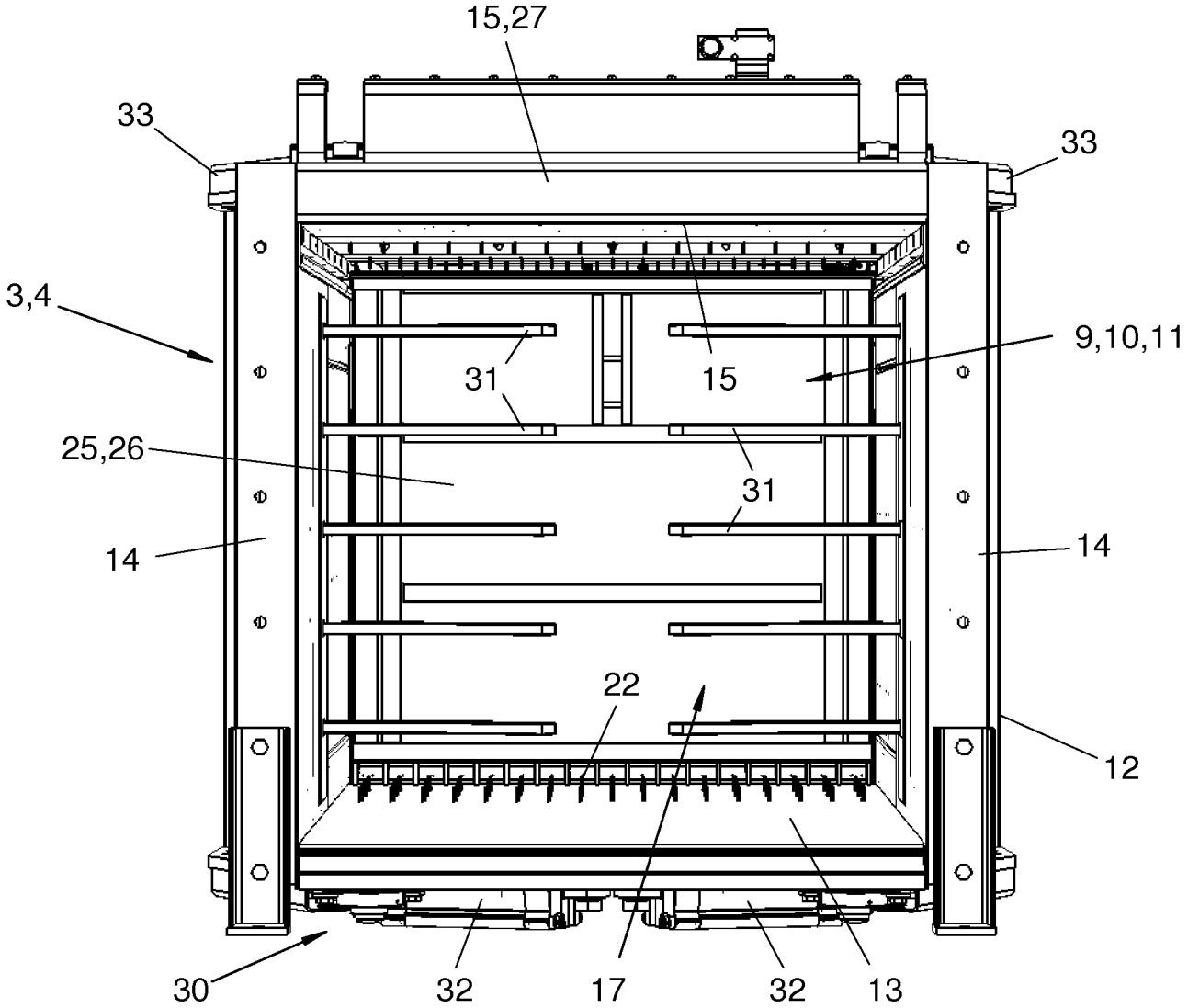
FIG. 6 is a front view of the filling device according to arrow VI from FIG. 4.

As FIG. 6 illustrates, the slide wall (26) completely or at least largely fills up the inner cross section of the collecting chamber (9). In the exemplary embodiment being shown, one or more upright wipers (22) are arranged on the chamber bottom (13) and are preferably grouped into one or more cross rows. The slide wall (26) can pass over the wipers (22) and comprises corresponding recesses on the bottom side for this. The wipers (22) are preferably located in the collection area (10) and have a triangular shape rising towards the discharge opening (17) and then falling abruptly.

Figure 3:
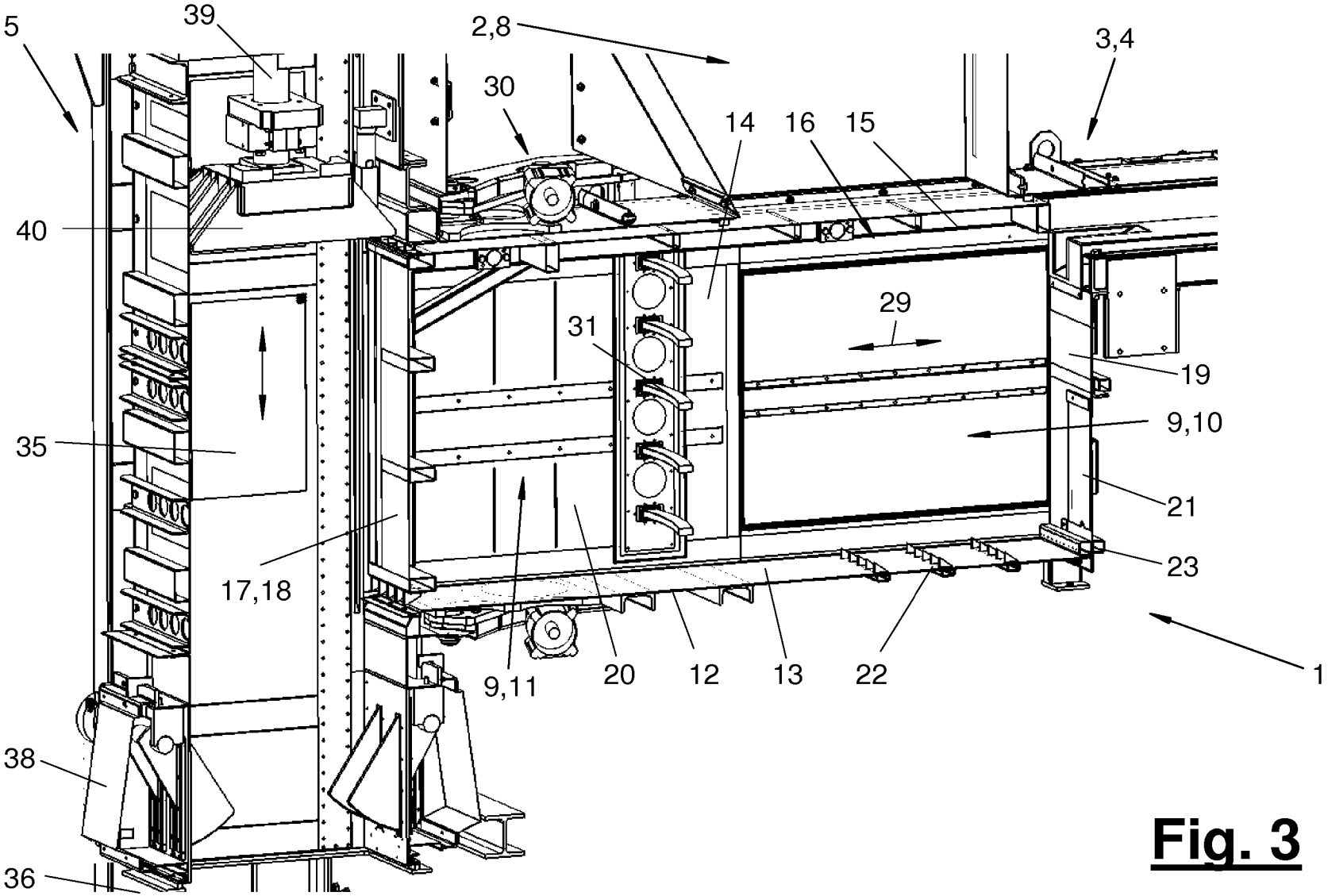
FIG. 3 is a broken-off and enlarged perspective view of the filling device from FIG. 2.

The chamber housing (12) may comprise a blowing device (23) in the area of the inoperative position of the slide (25) or at the rear wall (19). This blowing device is preferably arranged in the bottom area. It may be directed towards the wiper or wipers (22) and blows the bottom side of the slide wall (26) clear as needed, especially during the return stroke of the slide. FIGS. 3 and 7 show this arrangement.

Further, an air flap (21), which is likewise shown in FIGS. 3 and 7, may be arranged at the rear wall (19). It is preferably located on the inner side pointed towards the collecting chamber (9) and lets ambient air from the outside flow into the collecting chamber (9) during the feed of the slide (25). The air flap (21) closes during the return stroke of the slide (25), and the air displaced by the slide can escape through another vent in the collection area (10) or in a different manner.

The chamber housing (12) may further comprise a suction device (24) in the area of the inoperative position of the slide (25). This suction device (24) is arranged, e.g., on the outside at the rear wall (19) according to FIG. 7. The suction device (24) suctions fibers possibly located behind the slide wall (26).

The suction device (24) and/or the blowing device (23) may avoid the spreading of fibers in case the fibrous material (6) is changed during the operation. In addition, fibers possibly contaminated due to abrasion or for other reasons are prevented from reaching the collected and precompacted as well as subsequently pressed fibrous material (6).

A variety of variants of the embodiments shown and described are possible. Especially, the features of the exemplary embodiments and of the mentioned variants may be combined with one another as desired and also possibly be exchanged with one another.

As a variation on the described embodiment, the precompacting device (4) may precompact the batch of fed fibers each individually and at the same time discharge it the batch of fed fibers to the pressing device (5). The slide (25) then performs a compaction stroke during each feed and a constant ejection stroke after opening the closure (18).

The retaining device (30) may be configured in a different way, wherein, e.g., different retaining elements are used instead of the arms (31). These retaining elements may also possibly remain in the collecting chamber (9) As a variation on the embodiment shown, the retaining arms (31) may have a straight shape and perform a linear back and forth motion. The drive technique is changed and adapted correspondingly.

While specific embodiments of the invention have been shown and described in detail to illustrate the application of the principles of the invention, it will be understood that the invention may be embodied otherwise without departing from such principles.

The invention claimed is:

1. A filling device for fibrous material on a baling press, wherein the filling device is configured for an arrangement between a fiber feed and a press shaft of a pressing device of the baling press, the filling device comprising:

a collecting chamber for the fibrous material with a feed opening as well as with a discharge opening directed to the press shaft;

an integrated precompacting device comprising a driven slide comprising an upright slide wall revereably movable between the openings of the collecting chamber, the integrated precompacting device being configured to collect the fibrous material in the collecting chamber and precompact the fibrous material in the collecting chamber with movement of the slide with a compaction stroke in one or more stages; and a controllable closure arranged at the discharge opening to the press shaft, wherein:

the controllable closure closes the discharge opening during the compaction stroke of the slide;

the collecting chamber is arranged horizontally or obliquely;

the slide is arranged in the collecting chamber and is revereably movable along a chamber bottom between the openings;

the precompacting device comprises an enlargement of the collecting chamber with a collection area and with a compaction area arranged downstream, which collection area and compaction area are arranged behind one another in a direction of feed of the slide;

the collection area and the compaction area are arranged in a closable chamber housing of the collecting chamber; and the feed opening is arranged above or on the side of the chamber housing and the discharge opening is arranged at a front end of the chamber housing.

2. A filling device in accordance with claim 1, wherein the precompacting device comprises a retaining device for retaining the fibrous material, which retaining device is arranged between the collection area and the compaction area.

3. A filling device in accordance with claim 1, wherein the precompacting device collects the fibrous material, which has been fed in a plurality of batches, in the collecting chamber and precompacts it with a plurality of strokes of the slide in the collecting chamber.

4. A filling device in accordance with claim 1, wherein:

the chamber housing comprises an enclosing, fiber-proof, closable wall at the compaction area; and the chamber housing comprises a vent at the compaction area.

5. A filling device in accordance with claim 1, wherein the chamber housing comprises a suction device in an area of an inoperative position of the slide.

6. A filling device in accordance with claim 2, wherein the retaining device comprises a plurality of retaining arms, which are movable and capable of dipping into the collecting chamber in a reversing manner, as well as a controllable drive.

7. A filling device in accordance with claim 6, wherein:

the plurality of retaining arms are arranged at an arm support, which is connected to the controllable drive;

the collection area and the compaction area are arranged in a closable chamber housing of the collecting chamber;

the feed opening is arranged above or on the side of the chamber housing and the discharge opening is arranged at a front end of the chamber housing; and the arm support is mounted rotatably about a pivot axis at a chamber housing.

8. A filling device in accordance with claim 7, wherein the retaining arms have a shape bent about the pivot axis.

9. A baling press for fibrous material, the baling press comprising:

a fiber feed;

a pressing device comprising a press shaft;

a filling device arranged between the fiber feed and the pressing device, wherein the filling device comprises:

a collecting chamber for the fibrous material with a feed opening as well as with a discharge opening directed to the press shaft; and with an integrated precompacting device comprising a driven slide comprising an upright slide wall reverseably movable between the openings, the precompacting device being configured to collect the fibrous material in the collecting chamber and precompact the fibrous material in the collecting chamber with movement of the slide with a compaction stroke in one or more stages; and a controllable closure arranged at the discharge opening directed to the press shaft, wherein:

the controllable closure closes the discharge opening during the compaction stroke of the slide;

the collecting chamber is arranged horizontally or obliquely;

the slide is arranged in the collecting chamber and reverseably moves along a chamber bottom between the openings;

the precompacting device comprises an enlargement of the collecting chamber with a collection area and with a compaction area arranged downstream, which collection area and compaction area are arranged behind one another in a direction of feed of the slide;

the collection area and the compaction area are arranged in a closable chamber housing of the collecting chamber; and the feed opening is arranged above or on the side of the chamber housing and the discharge opening is arranged at a front end of the chamber housing.

10. A baling press in accordance with claim 9, wherein:

the pressing device comprises an upright press shaft with a press drive and with a press plunger;

the collecting chamber is aligned at right angles or obliquely in relation to the press shaft.

11. A baling press in accordance with claim 9, wherein the closure is arranged between the collecting chamber and the press shaft.

12. A filling method for fibrous material on a baling press by means of a filling device, which is arranged between a fiber feed and a pressing device comprising a press shaft, the method comprising the steps of:

feeding the fibrous material through a feed opening into a collecting chamber of the filling device and discharging fibrous material through a discharge opening to the press shaft of the pressing device, wherein the fibrous material in the filling device is moved with a driven slide that comprises an upright slide wall and moves in a reversing manner between the openings;

collecting the fibrous material in the collecting chamber by means of an integrated precompacting device of the filling device; and precompacting collected fibrous material in the collecting chamber with the moving slide in one or more stages, wherein the collecting chamber is provided with a controllable closure for the discharging of the precompacted fibrous material to the press shaft through the discharge opening, which is provided with the controllable closure, wherein:

the controllable closure closes the discharge opening;

the collecting chamber is arranged horizontally or obliquely;

the slide is arranged in the collecting chamber and moves in a reversing manner along a chamber bottom between the openings during a compaction stroke of the slide;

the precompacting device collects the fibrous material, which has been fed in a plurality of batches, and precompacts the fibrous material with a plurality of strokes of the slide in the collecting chamber; and the fibrous material is retained with a retaining device in the collecting chamber during the precompaction.

13. A filling method in accordance with claim 12, wherein the precompaction of the fibrous material in the collecting chamber and the pressing of the fibrous material, which is carried out at a higher pressing pressure, in the pressing device are chronologically overlapped during the formation of the pressed bale.

14. A filling method in accordance with claim 12, wherein the fed fibrous material is buffered during collection and precompaction in the filling device and the fiber volume is thereby reduced.

15. A baling press in accordance with claim 9, wherein:

the precompacting device further comprises a retaining device for retaining the fibrous material, which retaining device is arranged between the collection area and the compaction area;

the retaining device comprises a plurality of retaining arms, which are configured to move and to reverseably dip into the collecting chamber and be retracted therefrom, and a controllable drive driving the retaining arms;

the plurality of retaining arms are arranged at an arm support, which is connected to the controllable drive;

the collection area and the compaction area are arranged in a closable chamber housing of the collecting chamber;

the feed opening is arranged above or on a side of the chamber housing and the discharge opening is arranged at a front end of the chamber housing; and the arm support is mounted rotatably about a pivot axis at a chamber housing.

16. A filling device for fibrous material on a baling press, wherein the filling device is configured for an arrangement between a fiber feed and a press shaft of a pressing device of the baling press, the filling device comprising:

a collecting chamber for the fibrous material with a feed opening as well as with a discharge opening directed to the press shaft;

an integrated precompacting device comprising a driven slide comprising an upright slide wall revereably movable between the openings of the collecting chamber, the integrated precompacting device being configured to collect the fibrous material in the collecting chamber and precompact the fibrous material in the collecting chamber with movement of the slide with a compaction stroke in one or more stages; and a controllable closure arranged at the discharge opening to the press shaft, wherein:

the controllable closure closes the discharge opening during the compaction stroke of the slide;

the collecting chamber is arranged horizontally or obliquely;

the slide is arranged in the collecting chamber and is revereably movable along a chamber bottom between the openings;

the precompacting device comprises an enlargement of the collecting chamber with a collection area and with a compaction area arranged downstream, which collection area and compaction area are arranged behind one another in a direction of feed of the slide;

the precompacting device comprises a retaining device for retaining the fibrous material, which retaining device is arranged between the collection area and the compaction area; and the retaining device comprises a plurality of retaining arms, which are movable and capable of dipping into the collecting chamber in a reversing manner, as well as a controllable drive.

17. A filling device in accordance with claim 16, wherein:

the plurality of retaining arms are arranged at an arm support, which is connected to the controllable drive;

the collection area and the compaction area are arranged in a closable chamber housing of the collecting chamber;

the feed opening is arranged above or on the side of the chamber housing and the discharge opening is arranged at a front end of the chamber housing; and the arm support is mounted rotatably about a pivot axis at a chamber housing.

18. A filling device in accordance with claim 17, wherein the retaining arms have a shape bent about the pivot axis.

19. A filling device in accordance with claim 17, wherein:

the slide comprises a controllable drive;

the controllable drive of the slide is controlled such that the slide performs a plurality of compaction strokes during a collection operation with the discharge opening closed and precompacts the fibrous material in the compaction area in a plurality of stages.

20. A filling device in accordance with claim 19, wherein the drive of the slide and the controllable drive of the retaining device are controlled in an interdependent manner.

* * * * *